US006578668B2

(12) United States Patent
Haltom

(10) Patent No.: US 6,578,668 B2
(45) Date of Patent: Jun. 17, 2003

(54) CLIMBER COMFORT AND SAFETY PADS

(75) Inventor: Michael Lee Haltom, Glendale, AZ (US)

(73) Assignee: Michael L. Haltom, Glendale, AZ (US)

( * ) Notice: Subject to any disclaimer, the term of this patent is extended or adjusted under 35 U.S.C. 154(b) by 0 days.

(21) Appl. No.: 09/885,504

(22) Filed: Jun. 20, 2001

(65) Prior Publication Data

US 2001/0054526 A1 Dec. 27, 2001

Related U.S. Application Data

(60) Provisional application No. 60/213,433, filed on Jun. 22, 2000.

(51) Int. Cl.[7] ..... A63B 27/00

(52) U.S. Cl. ..... 182/221; 182/134

(58) Field of Search ..... 182/221, 134–136, 182/133, 3, 189; 36/62, 113, 66, 7.1 R, 136; 248/216.1, 217.3, 218.4

(56) References Cited

U.S. PATENT DOCUMENTS

| | | | | | |
|---|---|---|---|---|---|
| 1,505,360 | A | * | 8/1924 | Lowery | 182/134 |
| 1,727,237 | A | * | 9/1929 | Katz | 182/221 |
| 2,835,426 | A | * | 5/1958 | Terry | 182/221 |
| 3,640,358 | A | * | 2/1972 | Smith | 182/221 |
| 4,153,139 | A | * | 5/1979 | Houch | 182/221 |
| 4,407,391 | A | | 10/1983 | Greenway et al. | 182/9 |
| 4,530,420 | A | * | 7/1985 | Hobbs | 182/221 |
| 4,595,078 | A | | 6/1986 | Greenway | 182/9 |
| 4,679,658 | A | * | 7/1987 | Demers | 182/221 |
| 4,730,702 | A | * | 3/1988 | Torbett | 182/221 |
| 4,938,313 | A | * | 7/1990 | Rullo et al. | 182/221 |
| 4,993,515 | A | * | 2/1991 | Green et al. | 182/221 |
| 5,016,734 | A | * | 5/1991 | Greenway | 182/221 |
| 5,231,775 | A | * | 8/1993 | Trent, Jr. | 182/221 X |
| 6,148,959 | A | * | 11/2000 | Shay | 182/221 |

* cited by examiner

*Primary Examiner*—Daniel P. Stodola
*Assistant Examiner*—Hugh B. Thompson

(57) ABSTRACT

A leg and knee protecting pole climber assembly to facilitate the climbing of vertical poles and trees while protecting and adding comfort to the user, which includes a hook comprising an elongated shank section to be secured about a person's leg and a stirrup section integrally connected to the elongated shank section and at substantially a right angle to the elongated shank section, a stirrup section to hold the person's foot in place within the hook; also included is a gaff extending outwardly from the hook for engaging and gripping a climb surface; a strap for strapping the person's foot into the stirrup section and for strapping the person's upper leg to the elongated section; the elongated section comprises an interior surface abutting the leg of the person and an exterior surface opposite of the interior surface facing away from the person, the elongated section extending up the leg to above the user's calf; and a pad secured to the elongated section of the hook, the pad further comprising an upper leg securing and protection member section, the upper member section including spaced threadable engagement holding attachments for threadable engagement with a strap member to secure the pad and the elongated section to a user's leg at least above the calf and an elongated lower member section integrally associated with the upper member section, wherein the association of the upper member section and the lower member section form substantially a right angle to each other and wherein the elongated lower member section further includes a threaded member for engagement with the elongated section of the hook.

18 Claims, 5 Drawing Sheets

CLIMBER COMFORT AND SAFETY PADS

CROSS REFERENCE TO CO-PENDING PROVISIONAL APPLICATION

This application claims priority to co-pending provisional application Ser. No. 60/213,433 with a filing date of Jun. 22, 2000, entitled Climber Comfort and Safety Pads, inventor Michael L. Haltom of 7430 West Tina Lane, Glendale, Ariz. 85310.

BACKGROUND OF THE INVENTION

1. Field of the Invention

The present invention relates generally to vertical pole or tree climbers that are commonly used by utility workers and loggers. These climbers generally comprise metal shanks or hoods that form stirrups that extend up the side of one's legs and include a pointed spur or gaff to allow the person to climb up vertical wooden poles and trees. Still more particularly the present invention provides for a novel protective structure in communication with said spur or gaff.

2. Related Art

Pole climbers are used by lineman, lumberjacks and tree climbing men to assist them in climbing utility poles and trees. The design of pole climbers is such that the metal shank running up the side of the leg pushes into the side of the leg and causes great discomfort. The hook, when pushed into a utility pole or tree, pivots on the gaff and pushes the metal shank into the side of the leg at the knee. After a short period of being exposed to this prolonged pressure, this area on the side of the leg becomes very sore and uncomfortable. Numerous pole climbing devices are in the market and have been patented which relate to various aspects of pole climbing. For example, U.S. Pat. No. 4,595,078 entitled, "Fall arrest device for pole climbers" includes a fall arrest device for a pole climber which has a main yoke with resiliently biased arms at each end for partly encompassing a pole. The resiliently biased arms are movable in the same plane as the main yoke and also urge the secondary yokes into contact with the pole to accommodate a range of pole diameters. Handles are attached to each arm for gripping by the pole climber to move the arms so that the fall arrest device can be raised or lowered, and each arm also has eyelets for receiving safety straps attached to the pole climber. Thus, the '078 patent relates generally to fall arrest devices for the safety of pole climbers.

U.S. Pat. No. 4,993,515 entitled, "Pole climber assembly" relates to a pole climber assembly that helps prevent the user from being electrocuted by contact of any part of the assembly with an electrical source. The assembly includes a hook or stirrup which is molded of a nonconductive composite material. The composite material has the strength of a stell stirrup and features of the assembly include calf pads and straps that may be made of nylon, a non-skid thermoplastic pad on the exterior side of the stirrup to prevent wear of the composite material resulting from walking use, and an adjustable section allowing the pole climber to be adapted to users of any height. Although the '515 patent mentions a calf pad, it is inadequate protection for the upper leg and has proven to lack the protection and comfort addition of the present invention.

U.S. Pat. No. 4,407,391 entitled, "Pole climber's safety device" describes a pole climber's safety device which comprises a closed yoke for encompassing a pole, the yoke providing an attachment plate for attaching a safety belt and handle portions to be grasped by the climber. The yoke is formed by two half yokes hingedly interconnected together and secured by a releasable fastening. Pivoted blades are mounted on the underside of the yoke, and blades being biased to a pole engaging position and being manually retractable. Again, the '391 patent does not include the upper leg protection of the present invention.

U.S. Pat. No. 4,530,420 entitled, "Leg protector and socket for climbers" describes a tree and pole climber consisting of an inflexible socket member connected to a foam pad member which is designed to receive the shank portions of most commercial tree climbers. The socket member is formed so that the shank of the tree climber can rotate axially, can pivot forwardly and rearwardly in a plane at right angles to the stirrup of the climber and can pivot outwardly from the leg of the climber. The movement of the shank in the inflexible socket permits freedom of movement of the foot and thereby maximizes comfort in wearing the climber and minimizes chafing and injury to the leg of the workperson. Thus, although the '420 patent describes a good method of securing the shank member to the leg, it does not help solve the problem that has been unsolved in the climber's art today of protecting the upper leg from injury.

Thus, there is a need in the art to provide a device that securedly attaches a shank member to the leg and provides improved protection to the upper leg during climbing activities. A device is needed that can overcomes the great discomfort caused by the metal shank running up the side of the leg that is pushing into the side of the leg and thus causing great discomfort due to the fact that the hook, when pushed into a utility pole or tree, pivots on the gaff and pushes the metal shank into the side of the leg at the knee.

SUMMARY OF THE INVENTION

It is therefore an object of the present invention to provide a device that securedly attaches a shank member to the leg and provides improved protection to the upper leg during climbing activities. This present invention overcomes the great discomfort caused by the metal shank running up the side of the leg that is pushing into the side of the leg by providing a padded member with a unique shape. The present leg and knee protecting pole climber assembly to facilitate the climbing of vertical poles and trees while protecting and adding comfort to the user, includes a hook comprising an elongated shank section to be secured about a person's leg and a stirrup section integrally connected to said elongated shank section and at substantially a right angle to said elongated shank section, said stirrup section to hold the person's foot in place within said hook; also included is a gaff extending outwardly from said hook for engaging and gripping a climb surface; strap means for strapping the person's foot into said stirrup section and for strapping the person's upper leg to said elongated section; said elongated section comprises an interior surface abutting the leg of the person and an exterior surface opposite of said interior surface facing away from the person, said elongated section extending up the leg to above the user's calf; and a pad secured to said elongated section of said hook, said pad further comprising an upper leg securing and protection member section, said upper member section including spaced threadable engagement holding attachments for threadable engagement with a strap member to secure said pad and said elongated section to a user's leg at least above the calf and an elongated lower member section integrally associated with said upper member section, wherein the association of said upper member section and said lower member section form substantially a right angle to each other and wherein said elongated lower member section further includes a threaded member for engagement with said elongated section of said hook.

DETAILED DESCRIPTION OF THE EMBODIMENTS

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in art. Like numbers refer to like elements throughout.

Figure 1:
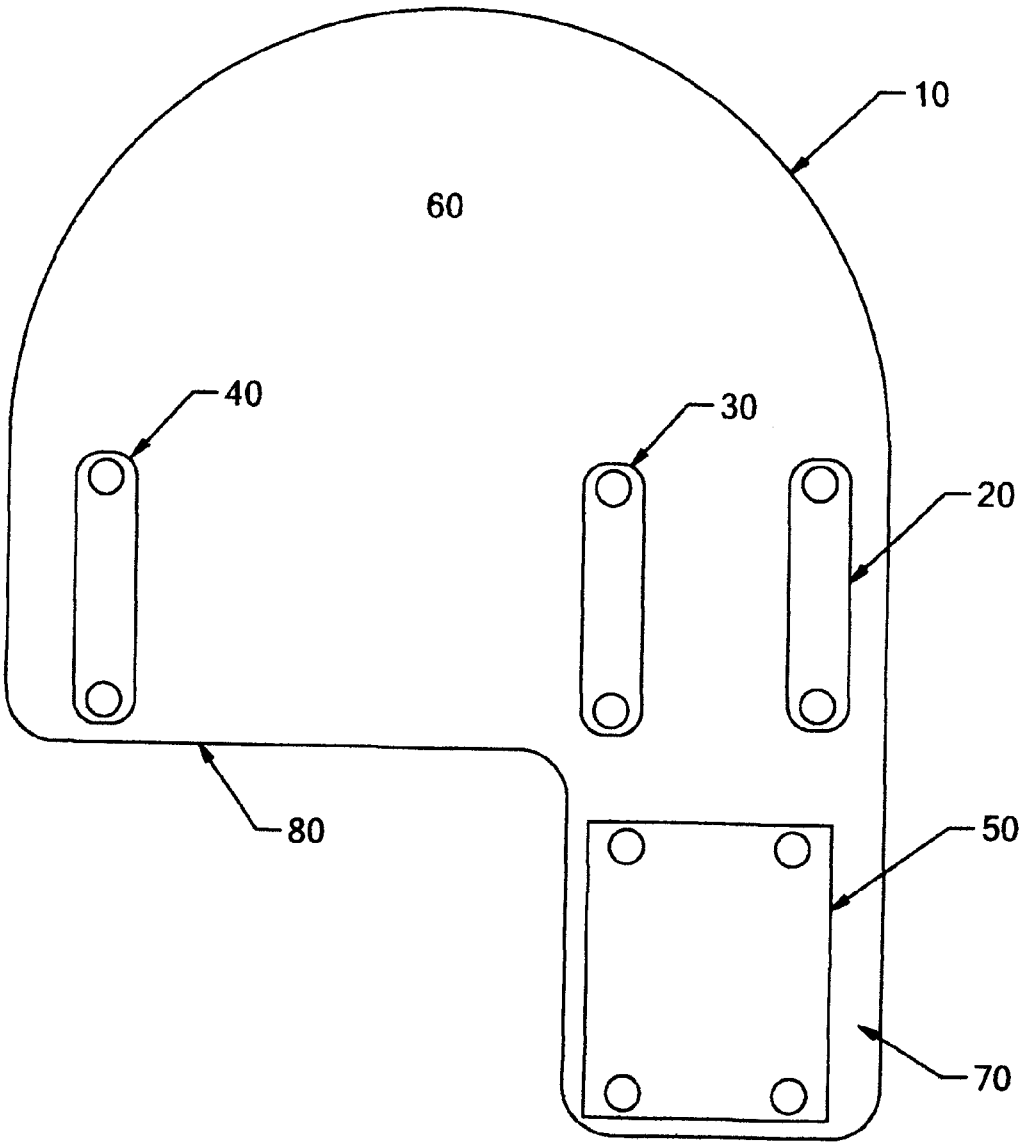
FIG. 1 is a side view of the pad used in the climber assembly of the present invention.

FIG. 1 is a side view of the pad 10 used in the climber assembly of the present invention. Lower portion 70 is integrally connected with upper portion 60 to allow for placement of the pad so as to protect the leg and particularly the upper above the calf area to include the knee. It is because of this unique shape that the this portion of the leg is able to be protected. The lower portion 70 can be as long as required to protect the leg as desired, thus accommodating various sized persons. In a preferred embodiment the upper portion 10 can be substantially circular and the bottom side 80 of the upper portion 60 can be substantially linear and substantially perpendicular to lower portion 70. Threaded portions 40, 30 and 20 allow for a strap to be inserted and used to secure the device to the user's leg. Thread 50 is used to secure the pad to a the shank portion of a hook as described below.

Figure 2:
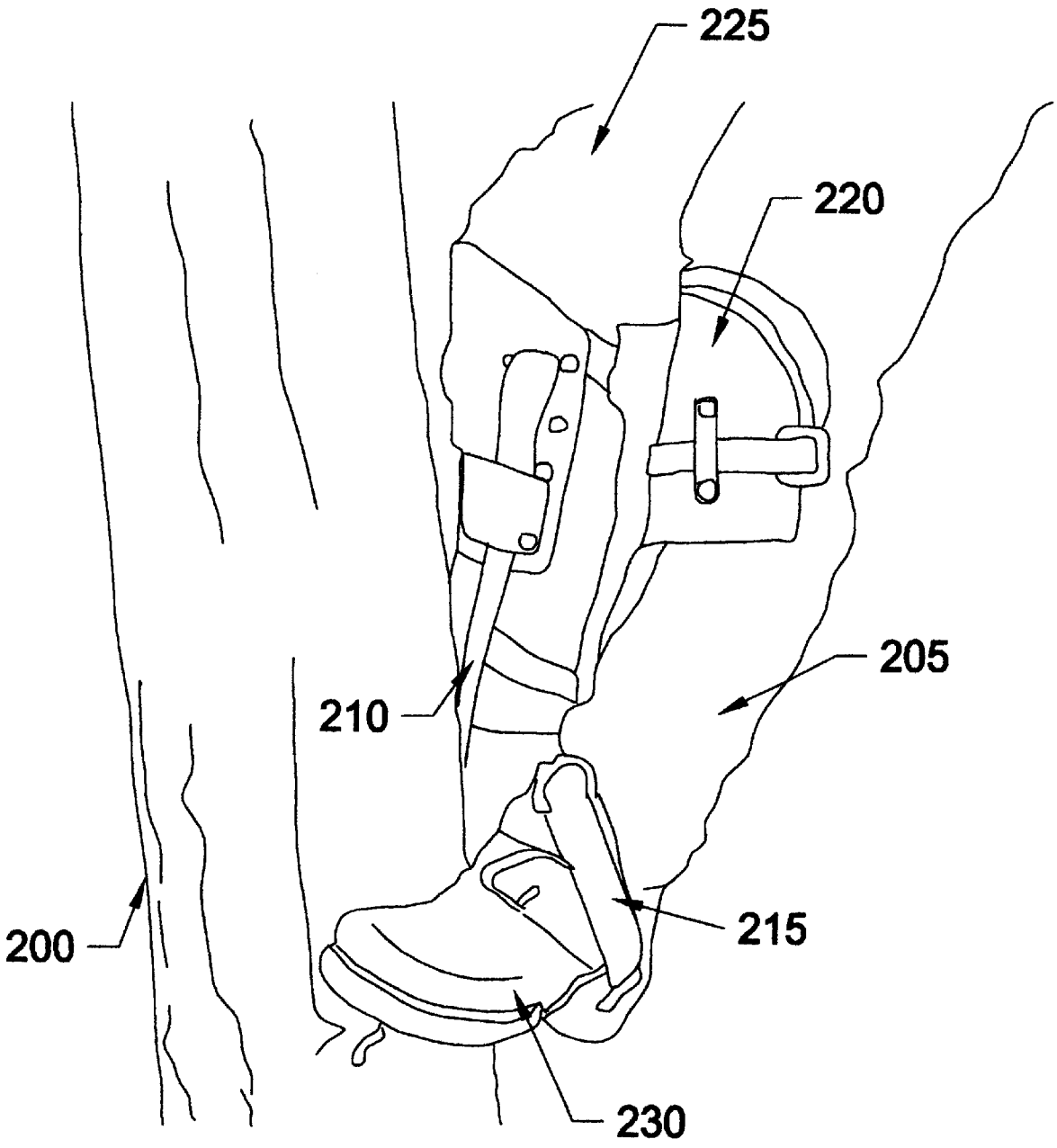
FIG. 2 illustrates the climber assembly worn by a user while climbing a pole.

FIG. 2 illustrates the climber assembly worn by a user while climbing a pole. The user 225 straps the climber assembly 220 on their leg 205. The gaff section 210 is stuck into pole or tree 200. Strap 215 is preferably used to secure the boot portion 230 of user 225.

Figure 3:
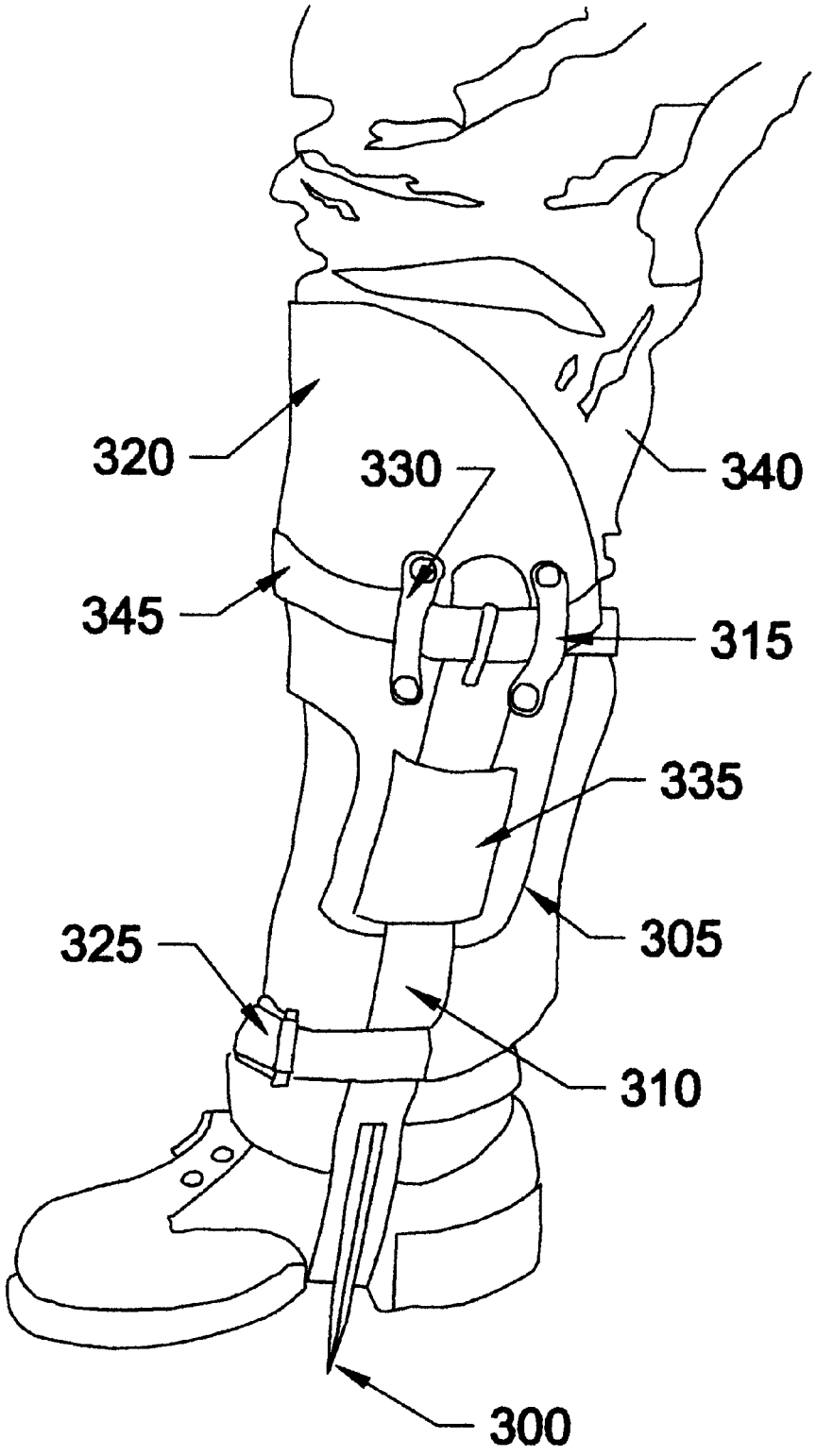
FIG. 3 depicts a side view of the climber assembly as worn by a user.

FIG. 3 depicts a side view of the climber assembly as worn by a user 340. Upper portion 320 of the pad 10 of climber assembly 220 can be secured to the user's leg 340 by strap 315 which is secured to the pad 10 by threads 330 and 315. As shown, the upper portion 320 protects the knee and upper portion of the leg. It can cover this portion of the leg because of the unique shape of the upper portion of the pad in combination with the integrally connected elongated lower portion 305. The lower portion of pad 10 protects the user from the elongated shank 310 and is secured to pad 10 by threaded engagement 335. An additional securing means to secure the climber assembly to the user is strap 325 that wraps around user's lower leg just above the user's ankle.

Figure 4:
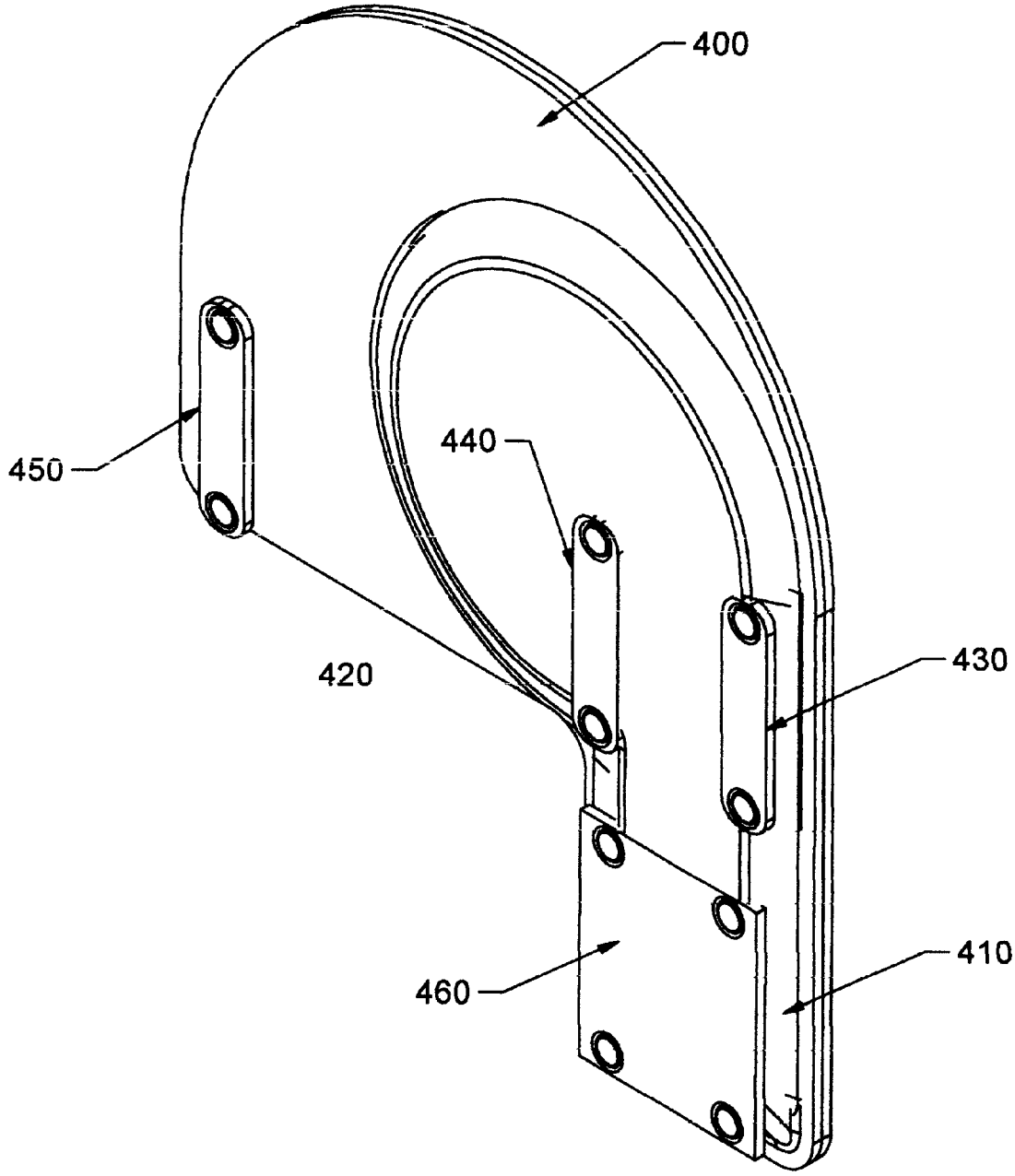
FIG. 4 illustrates the pad of the climber assembly and the threading means used for attaching an elongated member of a hook to the pad.

FIG. 4 illustrates the pad of the climber assembly and the threading means used for attaching an elongated member of a hook to the pad. This figure more clearly the threaded engagement members such as engagement member 460 which secures the elongated shank onto the pad at the lower portion 410 of the pad 10. Straps are secured to the pad 10 below upper portion 400 by the threaded engagements 450, 440 and 430. The threaded engagements 450, 440 and 430 are spaced on the pad to provide adequate securing to the pad. Shown at 420 is the unique shape of the pad created by the combining of the upper portion 400 of pad 10 and lower portion 410. This shape creates a substantially L shaped portion of the pad caused by the substantially horizontal lower side of the upper portion 400 and the interior side of lower portion 410. This shape allows for the protection of the knee and upper leg that has not been provided before in any climbing assemblies to prior to the invention herein.

Figure 5:
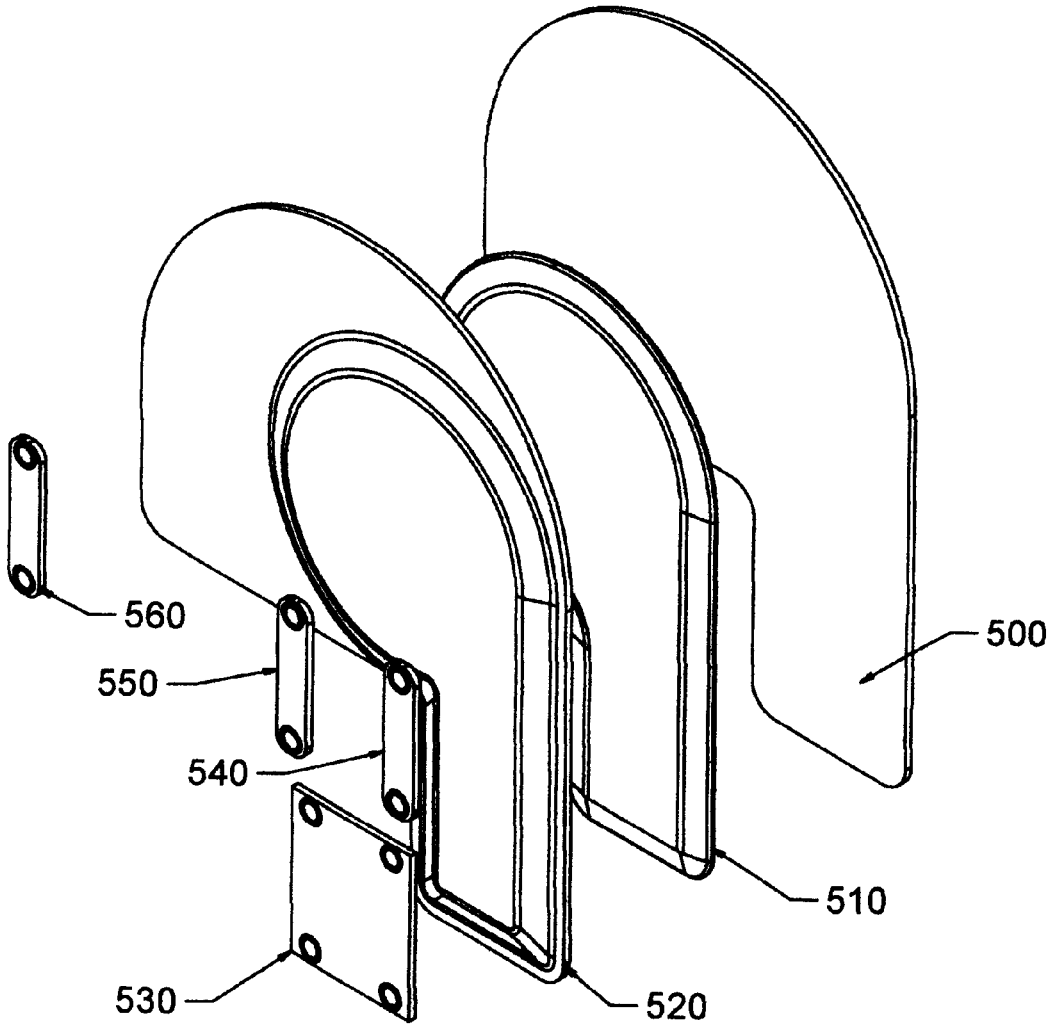
FIG. 5 illustrates the pad of the climber assembly and the various components therein.

FIG. 5 illustrates the construction of the pad 10 of the climber assembly and the various components therein. The pad 10 contains a back portion 500 and padding section 510 and a front section 520. The padding section can be made of dual density foam, although it is understood that one skilled in the art can use varying substances with varying thickness, with the primary concern being the safety and comfort of the user. The back portion 500, padding section 510 and front section 520 can be joined by stitching, although, again one skilled in the art can secure the two exterior sections with the padding in the interior by any means of securing, such as gluing, staplying, rivoting etc. The threaded engagement means are subsequently secured to the front section of the pad via rivoting or other securing means known well by those skilled in the art. The threaded engagement means for securing the elongated shank is shown at 530 and the threaded engagement means for securing the strap which secures the leg is shown at 560, 550 and 540.

In use the climber assembly will typically be used in pairs. One assembly for each leg. By strapping a climber assembly onto each leg and with the unique shape as herein described, the user's knee and upper leg portion are protected well. Also, because of the elongated shank portion of the climber assembly, structure stability and balance are achieved because a longer torque arm caused by the longer shank. Thus, the user has more control with the present invention that prior climber assemblies that attach at the calf level and provide no protection for the knee and upper leg.

It is to be understood that, while the detailed drawings and specific examples given describe preferred embodiments of the invention, they are for the purpose of illustration only, that the apparatus and method of the invention are not limited to the precise details and conditions disclosed and that various changes may be made therein without departing from the spirit of the invention which is defined by the following claims:

I claim:

1. A pad for integration into a climber assembly comprising:

a substantially circular upper leg securing and protection member section, said upper member section including spaced holding attachments for threadable engagement with a strap member; and an elongated lower member shank securing section integrally associated with and depending from said upper member section wherein a bottom side of said upper member section and said lower member section form substantially right angles to each other and wherein said elongated lower member section further includes a threaded member for engagement with a shank.

2. The pad of claim 1, wherein said pad further included a front section of said upper and lower members and a back section of said upper and said lower members, said front and back sections are secured together with a securing means.

3. The pad of claim 2 wherein said securing means is stitching.

4. The pad of claim 2, further comprising padding between said front and said back section.

5. The paid of claim 1, wherein said upper and said lower member sections are composed of leather.

6. The pad of claim 1, wherein said lower member section is elongated greater than three inches.

7. The pad of claim 1, wherein said threaded member is attached to said upper and lower member sections with rivets.

8. The pad of claim 1, wherein said threaded member is attached to said upper and lower member sections with stitching or rivets.

9. The pad of claim 1, wherein said lower member section is integrally associated with said upper member section at an end of said upper member section that allows upon placement of a user for a knee to be protected and for said elongated portion to protect an area extending below the knee from a shank member threaded into said threaded engagement member.

10. A leg and knee protecting pole climber assembly to facilitate the climbing of vertical poles and trees while protecting and adding comfort to a user, comprising:

a hook comprising an elongated shank section to be secured about a person's leg and a stirrup section integrally connected to said elongated shank section and at substantially a right angle to said elongated shank section, said stirrup section to hold the person's foot in place within said hook;

a gaff extending outwardly from said hook for engaging and gripping a climb surface;

strap means for strapping the person's foot into said stirrup section and for strapping the person's upper leg to said elongated section;

said elongated section comprises an interior surface abutting the leg of the person and an exterior surface opposite of said interior surface facing away from the person, said elongated section extending up the leg to above the user's calf; and a pad secured to said elongated section of said hook, said pad further comprising a substantially circular upper leg securing and protection member section, said upper member section including spaced threadable engagement holding attachments for threadable engagement with a strap member to secure said pad and said elongated section to the user's leg at least above the calf and an elongated lower member section integrally associated with said upper member section, wherein a bottom side of said upper member section and said lower member section form substantially a right angle to each other and wherein said elongated lower member section further includes a threaded member for engagement with said elongated section of said hook.

11. The leg and knee protecting pole climber assembly of claim 10, wherein said lower member section is elongated greater than three inches.

12. The leg and knee protecting pole climber assembly of claim 10, wherein said threaded member is attached to said upper and lower member sections with rivets.

13. The leg and knee protecting pole climber assembly of claim 10, wherein said threaded if member is attached to said upper and lower member sections with stitching or rivets.

14. A method of protecting the legs and knees of a climber, where said climber is using a pole or tree climber assembly, comprising the steps of:

providing an elongated section to a hook assembly;

providing a pad comprising a substantially circular upper leg securing and protection member section, said upper member section including spaced holding attachments for threadable engagement with a strap member and an elongated lower member section integrally associated with and depending from said upper member section wherein a bottom side of said upper member section and said lower member section form substantially right angles to each other and wherein said elongated lower member section further includes a threaded member for;

strapping said elongated section to the climbers leg via said pad engagement with said elongated section.

15. The method of claim 14 wherein the length of said elongated section allows for the said elongated section to be strapped onto the portion of the climber's leg above the calf.

16. A method of manufacturing a climber pad, comprising:

cutting a substantially circular front section to an upper leg securing and protection member section, said upper member section including spaced holding attachments for threadable engagement with a strap member and an elongated lower member shank securing section which is integrally associated with and depending from said upper member sections wherein a bottom side of said upper member section and said lower member section form substantially right angles to each other and wherein said elongated lower member section further includes a threaded member for engagement with a shank;

cutting a substantially circular back section to an upper leg securing and protection member section, said upper member section including spaced holding attachments for threadable engagement with a strap member and an elongated lower member shank securing section which is integrally associated with and depending from said upper member section wherein the association of said upper member section and said lower member section form substantially right angles to each other and wherein said elongated lower member section further includes a threaded member for engagement with a shank; and securing said front and back sections via a securing means.

17. The method of manufacturing of claim 16, wherein said securing means is stitching.

18. The method of manufacturing of claim 16, wherein said securing means is riveting.

* * * * *